United States Patent [19]

Pitalo et al.

[11] Patent Number: 4,762,411

[45] Date of Patent: Aug. 9, 1988

[54] BORESIGHT ALIGNMENT VERIFICATION DEVICE

[75] Inventors: Stephen K. Pitalo, Huntsville; Donnie T. Walden, Cullman; Henry P. Lay, Huntsville, all of Ala.

[73] Assignee: The Boeing Company, Seattle, Wash.

[21] Appl. No.: 97,331

[22] Filed: Sep. 10, 1987

Related U.S. Application Data

[63] Continuation of Ser. No. 712,103, Mar. 15, 1985.

[51] Int. Cl.[4] ..... G01B 11/26

[52] U.S. Cl. ..... 356/152; 350/623; 356/400

[58] Field of Search ..... 356/152, 153, 399, 400; 350/622, 623, 574, 577, 631, 540, 544

[56] References Cited

U.S. PATENT DOCUMENTS

| | | | |
|---|---|---|---|
| 3,551,057 | 12/1970 | Hamilton et al. | 356/153 |
| 4,108,551 | 8/1978 | Weber | 350/622 |
| 4,191,471 | 3/1980 | Courten et al. | 356/153 |
| 4,277,142 | 7/1981 | Gardner | 350/622 |
| 4,385,834 | 5/1983 | Maxwell, Jr. | 356/153 |
| 4,422,758 | 12/1983 | Godfrey et al. | 356/152 |
| 4,623,229 | 11/1986 | Galan | 350/623 |

FOREIGN PATENT DOCUMENTS

| | | | |
|---|---|---|---|
| 1008234 | 10/1965 | United Kingdom | 350/539 |

*Primary Examiner*—Stephen C. Buczinski
*Assistant Examiner*—Linda J. Wallace
*Attorney, Agent, or Firm*—Finnegan, Henderson, Farabow, Garrett & Dunner

[57] ABSTRACT

A boresight alignment verification device for testing sophisticated sighting and weapon systems used on various types of military aircraft and vehicles. The alignment device measures boresight error between a reference line of sight, a vehicle sighting system and a weapon system.

7 Claims, 10 Drawing Sheets

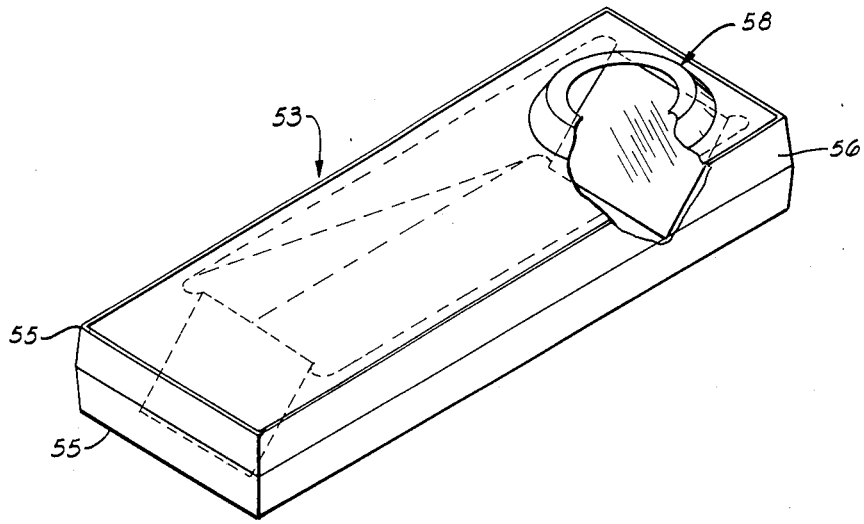
FIG. 5E
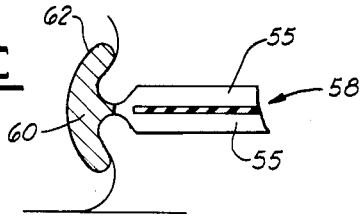
FIG. 5E1
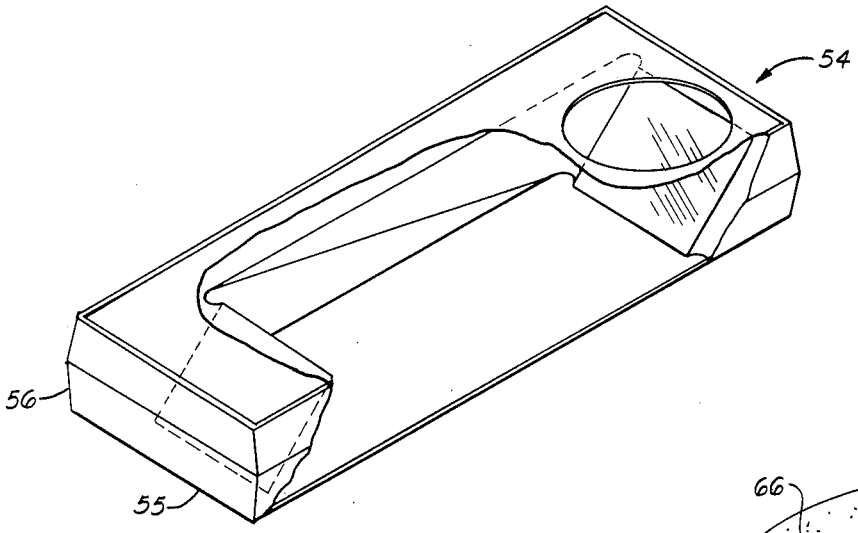
FIG. 5F
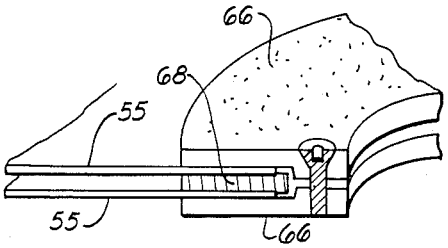
FIG. 5F1

FIG. 6A
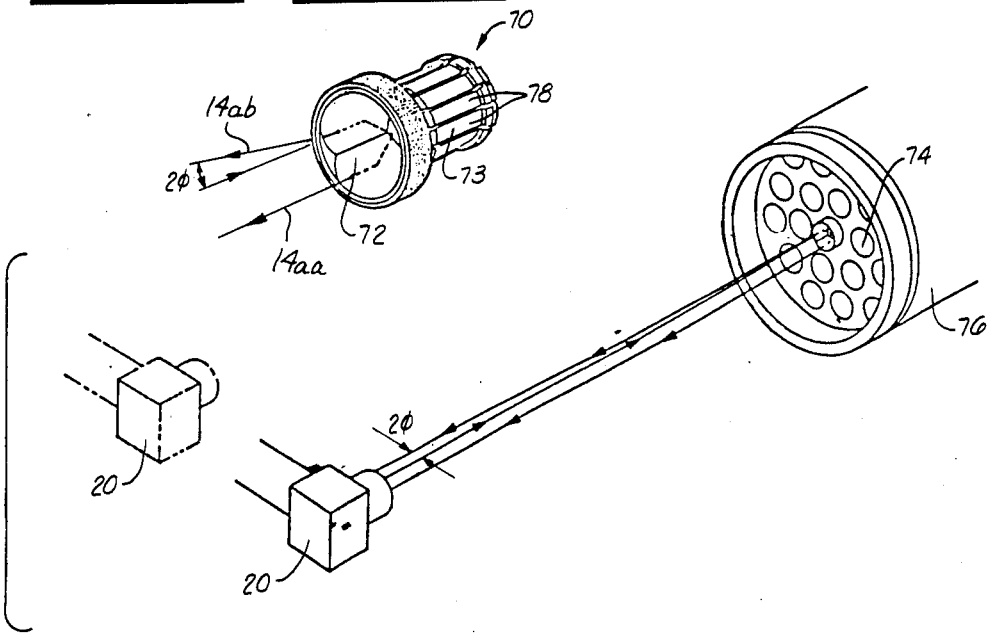
FIG. 6B
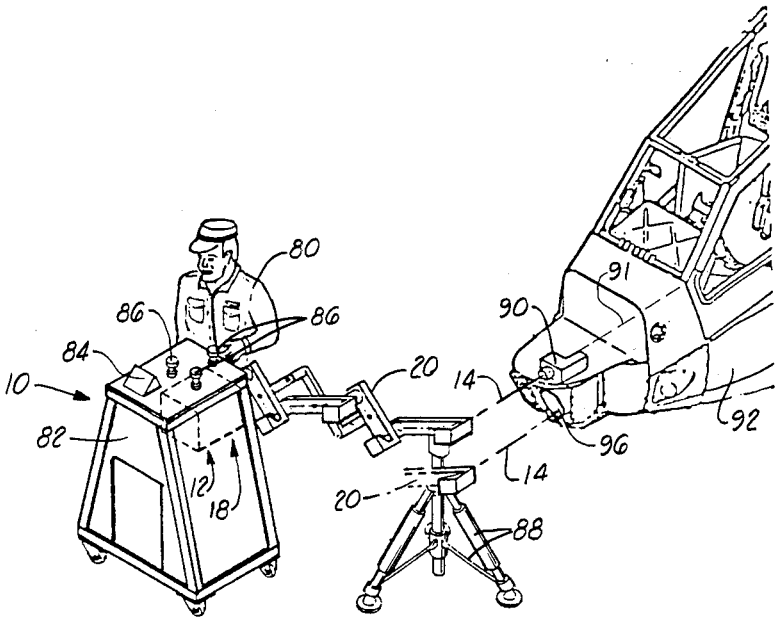
FIG. 7

BORESIGHT ALIGNMENT VERIFICATION DEVICE

This application is a continuation of application Ser. No. 712,103, filed Mar. 15, 1985.

BACKGROUND OF THE INVENTION

This invention relates to an alignment device and more particularly, but not by way of limitation, to a boresight alignment verification device for measuring boresight error between a reference line of sight, a vehicle sighting system and a weapon sighting system on aircraft and military vehicles.

With the addition of sophisticated sighting systems and weapon systems on military aircraft and vehicles, the problem of quick boresight alignment verification between a sighting system and a weapon system has not been solved. In order to verify these systems in a field environment, a test system is required that not only has appropriate quick boresight verification capability but is designed so that a semi-skilled operator can use the sighting device without misaligning the vehicle's subsystems, the boresighting instrument or both. Prior attempts to accomplish this type of testing were based on standard survey type telescopes and reticle target systems that require highly skilled personnel hours to verify the vehicle's subsystems boresight. The subject invention eliminates the above-mentioned problems and provides unique features and advantages that will be discussed herein.

SUMMARY OF THE INVENTION

The subject boresight alignment verification device is designed to quickly verify the boresight of a vehicle sighting system, line of sight system, and weapon system.

The device may be used on aircraft, ships, vehicles and any other commercial and military related equipment requiring boresight alignment testing.

The alignment verification device is simple in design and can be used by semi-skilled operators in the field of boresight verification.

The boresight verification device, for testing sophisticated sighting and weapon systems used on various types of military aircraft and vehicles, includes a boresight target reference source for projecting a collimated beam. An angle independent extendable periscope is connected to the reference source for extending the path of the collimated beam to a reference fixture mounted on the unit under test. A boresight error sensor is connected to the periscope for receiving the reflected collimated beam from the reference fixture and measuring the boresight error of the unit under test so that proper adjustments may be made.

The advantages and objects of the invention will become evident from the following detailed description of the drawings, when read in connection with the accompanying drawings which illustrate preferred embodiments of the invention.

BRIEF DESCRIPTION OF THE DRAWINGS

FIGS. 5E and 5F illustrate alternate embodiments of the individual periscope elements.

Figure 5A:
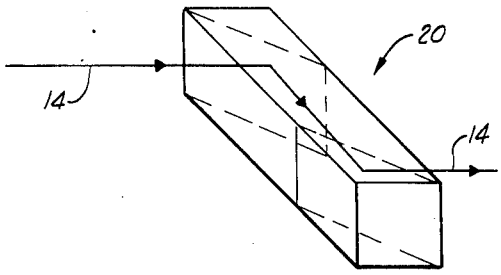
FIGS. 5A, 5B, 5C and 5D illustrate the path of the collimated beam received through the angle-independent extendable periscope when in perfect position and when misaligned in angle from the three orthogonal coordinates.
Figure 5B:
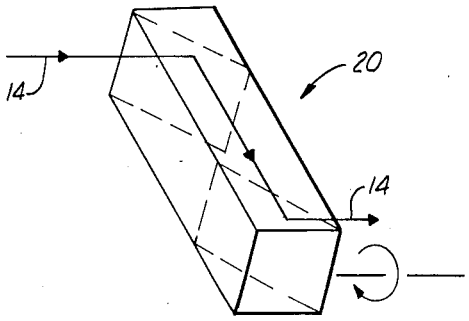
Figure 5C:
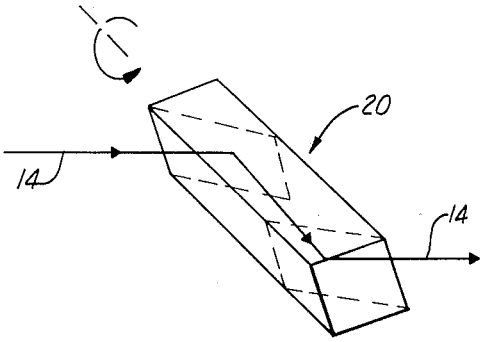
Figure 5D:
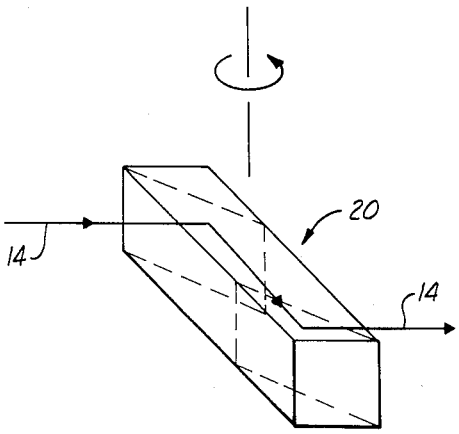

FIGS. $5E_1$ and $5F_1$ are cross-sectional views of alternative joint structures between cooperating periscope elements as depicted in FIGS. 5E and 5F.

FIG. 6A is a perspective view of an optical reference fixture.

FIG. 6B illustrates a weapon system with optical reference fixture in place and the operative relationship to the periscope.

FIG. 7 illustrates the verification device positioned in front of an optical reference fixture that is mounted on a portion of an aircraft.

Figure 8:
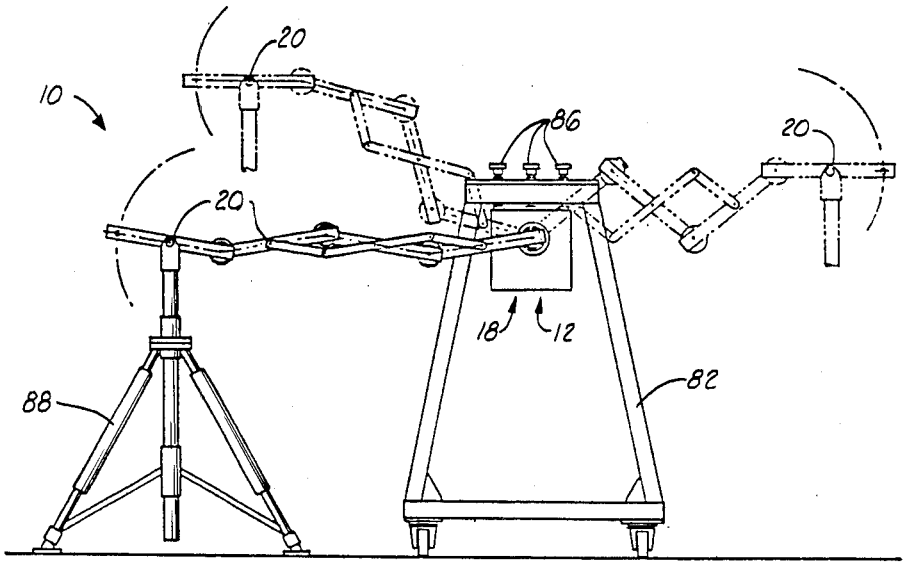

FIG. 8 illustrates a front view of the verification device.

FIGS. 9A, 9B, 9C, 9D and 9E illustrate the operation of the collimated beam and alignment of the aircraft line of sight with the optical reference fixture.

Figure 10:
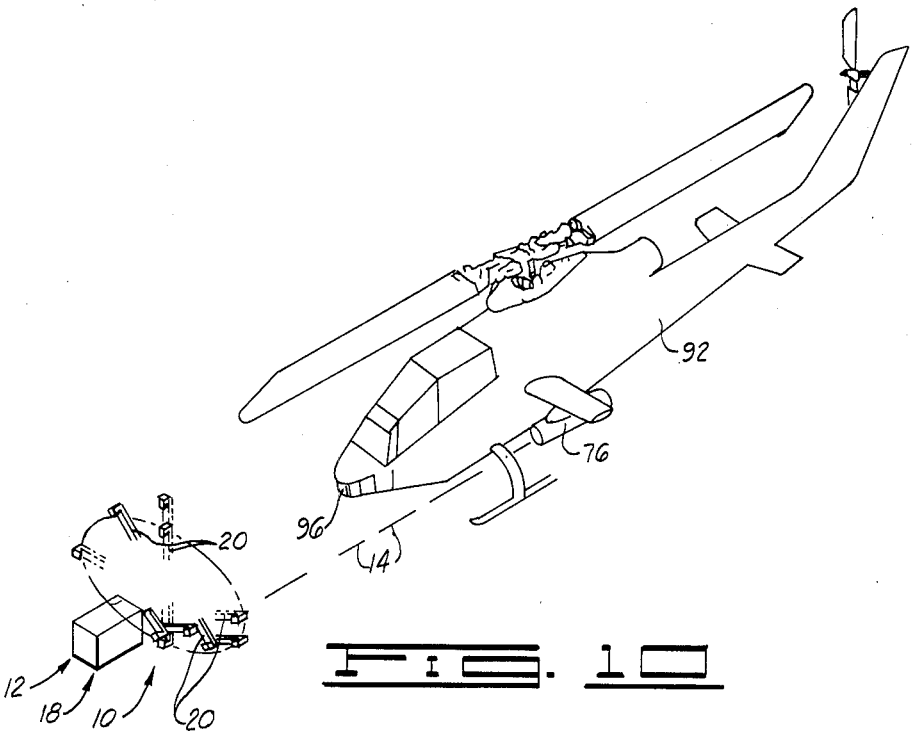

FIG. 10 illustrates the verification device positioned at various angles in front of the aircraft sighting system and rocket launcher.

DETAILED DESCRIPTION OF THE DRAWINGS

Figure 1:
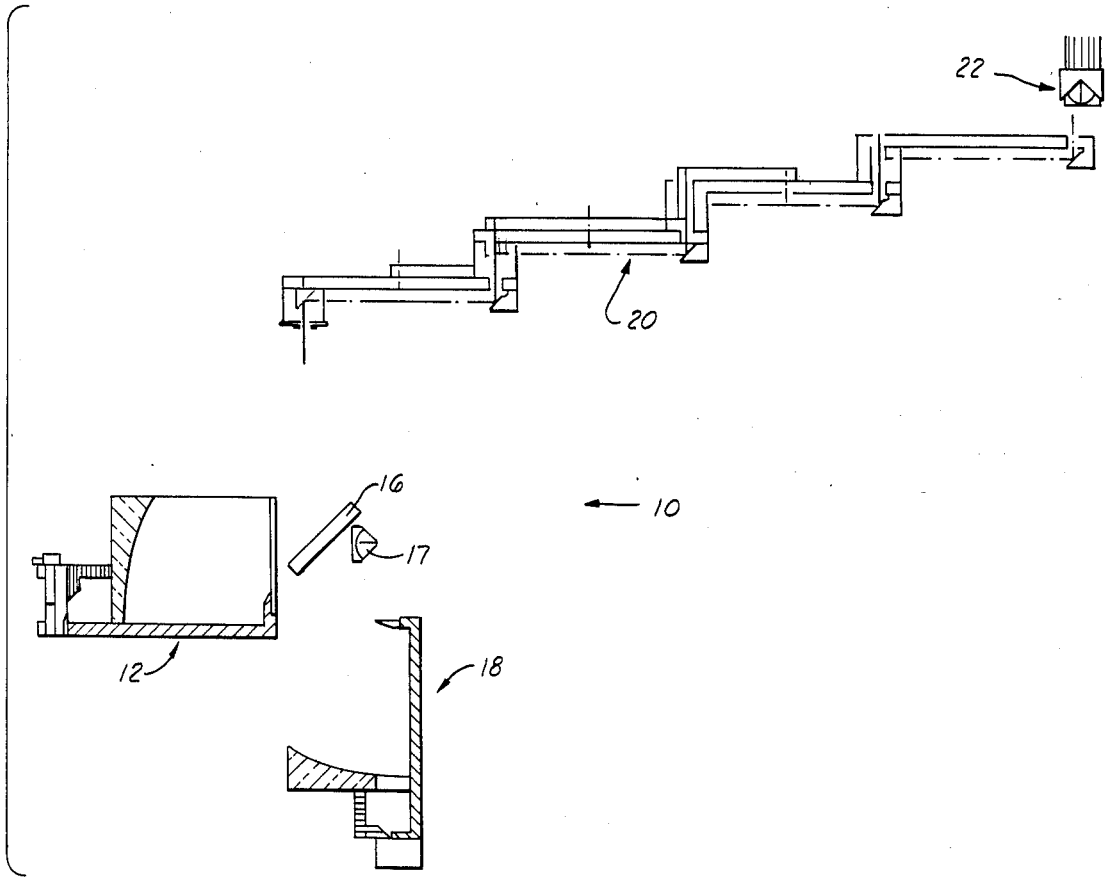
FIG. 1 illustrates the individual elements of the boresight alignment verification device of the invention.

In FIG. 1 the boresight alignment verification device is shown broadly and indicated by general reference numeral 10. The device is made up of a boresight target reference source 12 for projecting a collimated beam 14 shown in FIGS. 2A and 2B. The collimated beam 14 is received on a parallel plate beamsplitter 16 and cube corner prism 17 in front of a boresight error sensor system 18. The collimated beam 14 is split, with half of the beam received through an angle-independent extendable periscope 20 from which part of the collimated beam is discharged onto an optical reference fixture 22 which may be part of a sighting system on a military aircraft or vehicle or can be mounted along the line of sight of the aircraft or onto a portion of a weapon system.

Figure 2A:
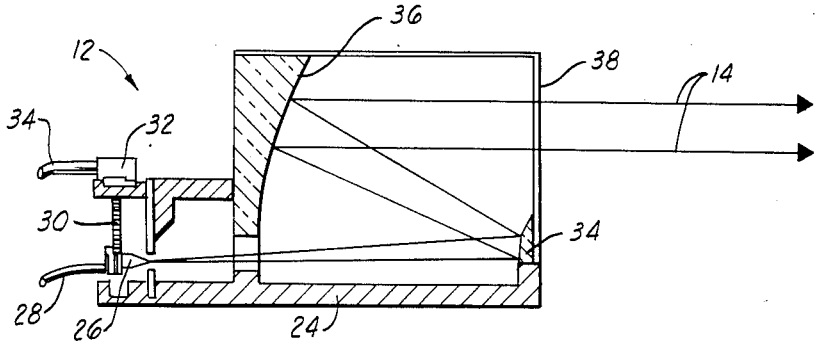
FIGS. 2A and 2B are enlarged cross-sectional views of the boresight target reference source and boresight error sensor.

In FIG. 2A an enlarged view of the reference source 12 is shown having a base plate 24 with a radiation image source 26 mounted thereon and having an electrical lead 28. For fine adjustment the radiation source 26 is attached to a worm gear 30 operated by a stepping motor 32 attached to electrical lead 34 for providing lateral translation in the fine adjustment of the collimated beam 14. The collimated beam 14 is reflected off of a pair of power mirrors 34 and 36 before being discharged from the source 12 through an exit window 38.

Figure 2B:
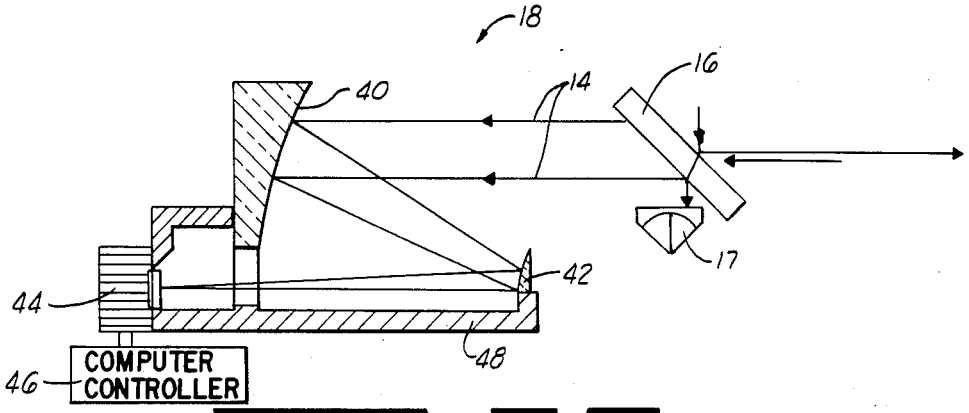
Figure 2D:
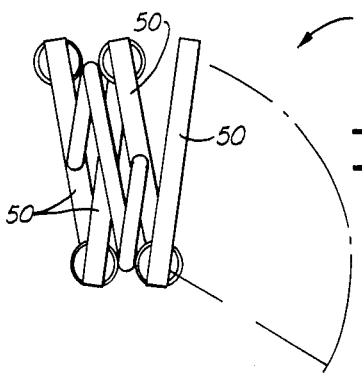
FIG. 2D is a side view of the periscope in the collapsed position.

Referring now to the boresight error sensor system 18 shown in FIG. 2B, a portion of the collimated beam 14 is received onto the beam-splitter 16 and the cube corner prism 17. The beam 14 is received onto a pair of power mirrors 40 and 42 mounted on a housing 48 and then focused onto a matrix camera 44 that is operated and controlled by a computer controller 46 with memory.

Figure 2C:
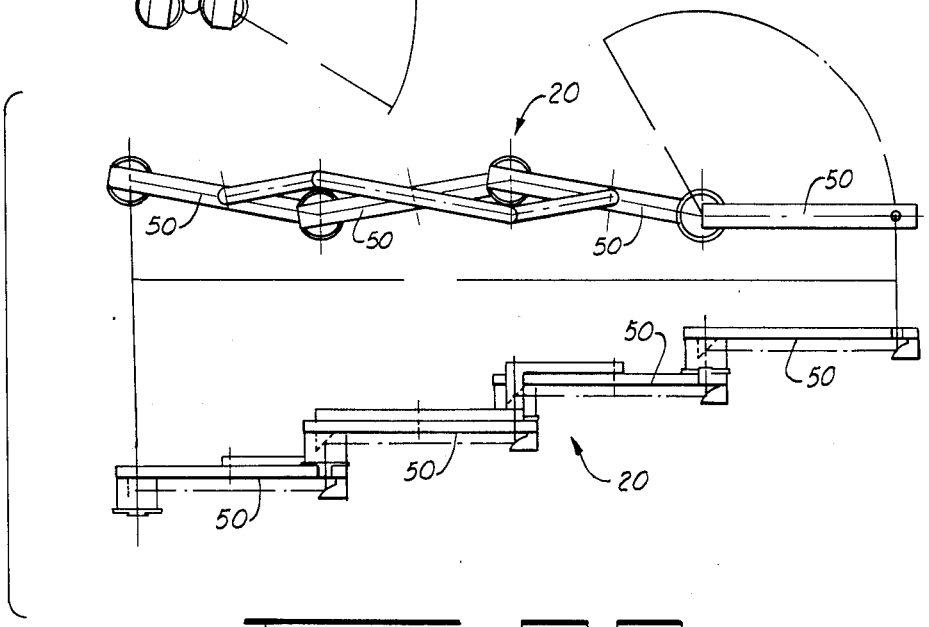
FIG. 2C depicts the top and side views of the periscope in the extended position.
Figure 4A:
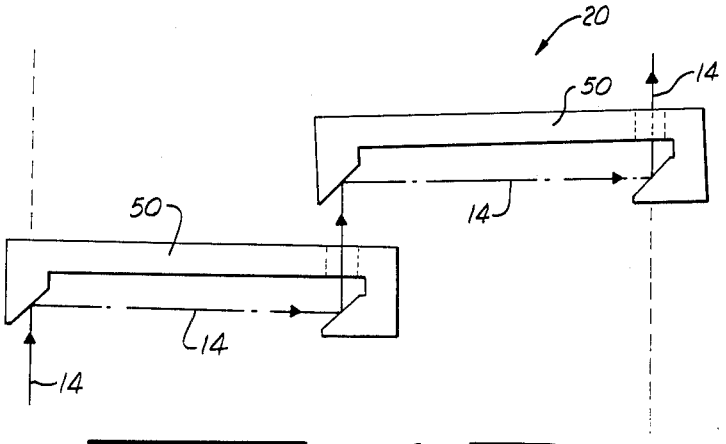
FIG. 4A is a side view of a pair of rhomboid reflectors as used in the periscope of the invention.
Figure 4B:
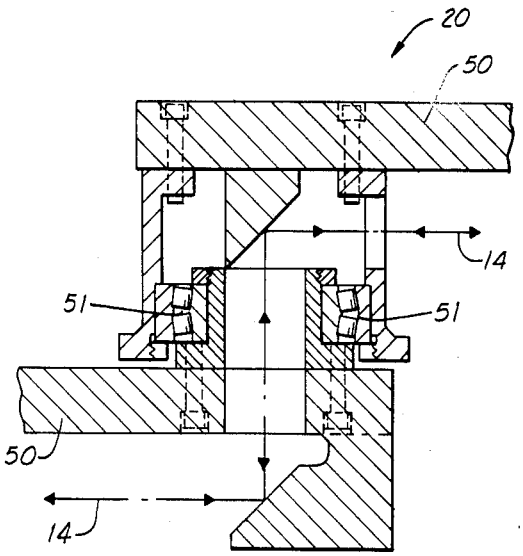
FIG. 4B is a cross-sectional side view of one of the articulating joints between a pair of rhomboid reflectors in the periscope.
Figure 4C:
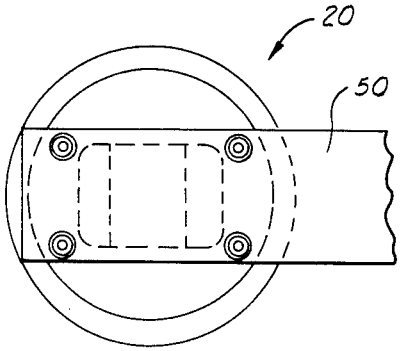
FIG. 4C is a top view of the joint depicted in FIG. 4B.

In FIG. 2C a top and side view of the angle-independent extendable periscope 20 is shown made up of a plurality of individual, cascaded, rhomboid reflector arms 50. The individual arms 50 are rotated with respect to each other, giving the periscope 20 a telescoping capability. In this Fig. the maximum and minimum extensions of the periscope 20 are shown. From reviewing FIG. 4A, 4B and 4C it should be noted that the individual arms 50 with roller bearings 51 may be wobbled in any angle without changing the line of sight of the collimated ray 14 after the ray is reflected through the periscope 20 and out the exit aperture. This is shown in FIGS. 5A, 5B, 5C and 5D.

Figure 3A:
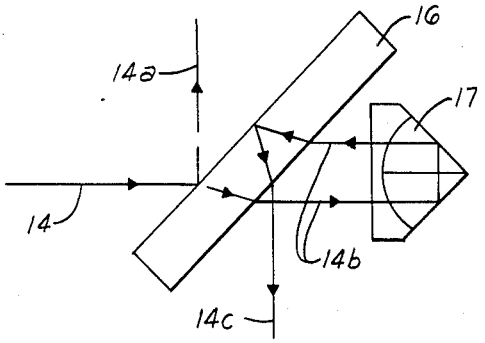
FIGS. 3A, 3B and 3C illustrate the reflected rays from the collimated beam onto a cube corner prism with parallel plate beam splitter.

In FIG. 3A, the collimated beam 14 is received on the 50% reflective/50% transmissive surface of the beamsplitter 16 that reflects 50% 14*a* of the energy of the beam 14 into the periscope system and transmits 50% 14*b* of the energy of the beam 14 through the parallel plate substrate of the beamsplitter 16 and into a cube corner prism 17. The prism 17 retroreflects and exits the beam 14*b* at the same angle that the beam 14*b* entered. The beamsplitter 16 receives the beam 14*b* from the cube corner prism 17 and once again partially reflects the beam 14*c* in a direction parallel to but 180° from the direction of the beam 14*a* entering the periscope. The parallel but 180° relationship of the two reflected beams 14*a*, 14*c* is always maintained regardless of the initial angle of incidence of the beam 14 onto the beamsplitter.

Figure 3B:
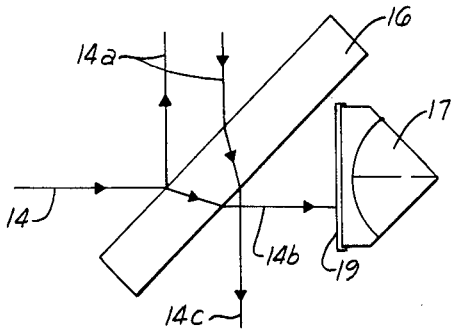

In FIG. 3B, the collimated beam 14 is received as before on the beam splitting surface 16 that reflects 50% 14*a* of the energy into the periscope and 50% 14*b* of the energy is transmitted through the beamsplitter substrate onto a shield 19 placed in front of the cube corner prism 14 where it is absorbed. The periscope is placed in front of a retroreflector that is mounted upon the item whose alignment is to be tested. The reflected beam 14*a* exits the periscope, impinges onto the retroreflector and is retroreflected back at the same angle that is entered. Consequently, the returning beam 14*a* is parallel but 180° in direction to the beam 14*a* that originally entered the periscope. The returning beam 14*a* then impinges onto the beamsplitter 16. Fifty percent 14*c* of the beam 14*a* is transmitted through the beamsplitter 16 substrate, where it maintains its angular direction, the parallel plate beamsplitter 16 not only laterally translating the beam 14*c* but also maintaining its angular integrity.

Figure 3C:
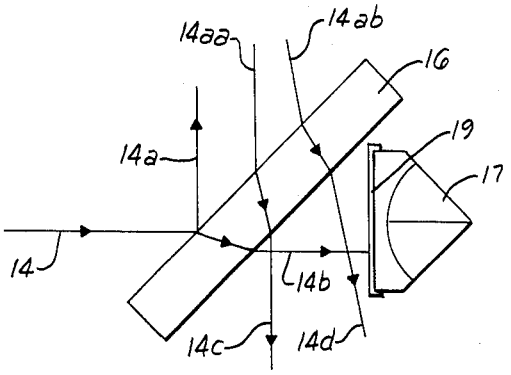

In FIG. 3C, the configuration of the beamsplitter 16, cube corner 17 and shield 19 combination is the same, as well as the periscope position. The retroreflector (not shown) that the periscope is positioned in front of is different. The retroreflector is a cube corner prism that has a 50% transmission/50% reflection coating on its entrance surface. When the beam 14*a* impinges upon this entrance surface, 50% 14*ab* is reflected at double the angle that the prism face is misaligned to the line of sight of the beam direction and 50% 14*aa* is transmitted into the prism where it is retroreflected back into the periscope at the angle the beam entered the prism. This is shown in FIG. 6A. The two beams, 14*ab* and 14*aa* reflected and retroreflected, travel through the periscope and back onto the beamsplitter 16 substrate and exit the beamsplitter 16 as lesser energy beams 14*c*, 14*d* maintaining their own angle integrity. The parallel plate beamsplitter 16 and cube corner prism 17 combination, as configured in FIGS. 3A, 3B and 3C, is used in combination with the periscope, projector sensor and optical reference fixture and is discussed later with reference to FIGS. 6 through 10.

In FIGS. 5E and 5F alternate embodiments of cascaded rhomboid reflector arms 53 and 54 are shown. The periscope 20 is made up of a plurality of either arm 53 or 54, wherein the mirrored surfaces are machined from the arm structure 56 at 90° from those of the previous arm 50. This configuration provides a periscope 20 of smaller dimension in the direction of input and output light rays, allowing a more compact and easily handled overall package. Either two-piece or one-piece sheet metal dust covers 55 complete the arm 53 or 54, providing environmental protection, eye safety and means of support. As shown in FIG. $5E_1$, arm rotary joints 58 include thin plastic bushings 60 having a formed clamp 62 therearound and supporting mirror covers 55. Also, the covers 55 may be supported by a pair of clamps 66 with bushing 68 as shown in FIG. $5F_1$ for providing an alternate rotary joint. The added advantage of these alternate embodiments is that support forces between the periscope elements bear upon the sheet metal dust covers 55 rather than on the periscope structure 56 itself. Thus, even with a large lever arm of several periscope elements, there is no tendency to disturb the mirror-to-mirror alignment within each arm and their angle-independent nature is preserved.

In FIG. 6A one type of an optical reference fixture 70 is illustrated having a cube corner prism 72 with a 50% reflection and 50% transmission coating on the entrance of the prism 72. The fixture 70 is attached to a self-centering spring-like compliant plug 73 that may be pushed into a barrel 74 making up a portion of, for example, a rocket launcher 76 or any similar weapon system (FIG. 6B). Splines 78 of the plug 73 expand and center the fixture 70 parallel to the boresight of the rocket launcher 76.

Figure 9A:
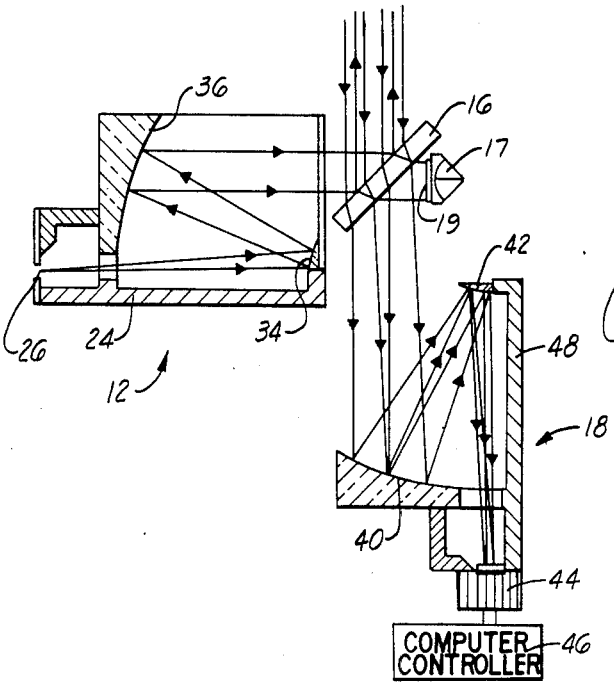
Figure 9B:
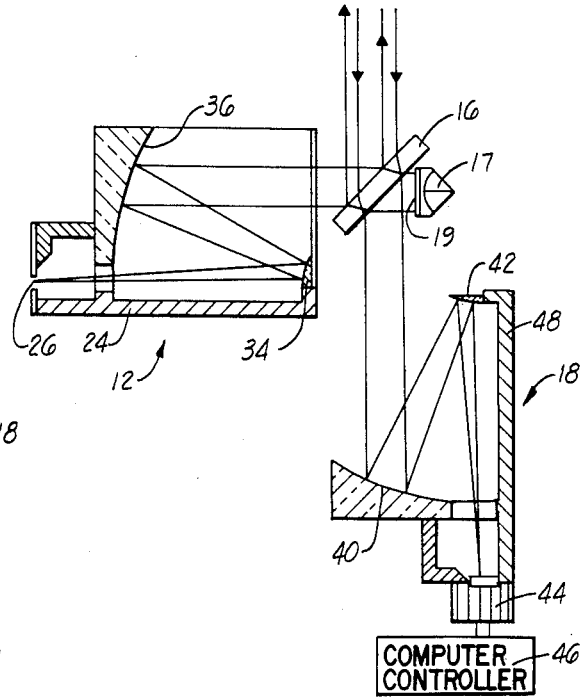
Figure 3C:
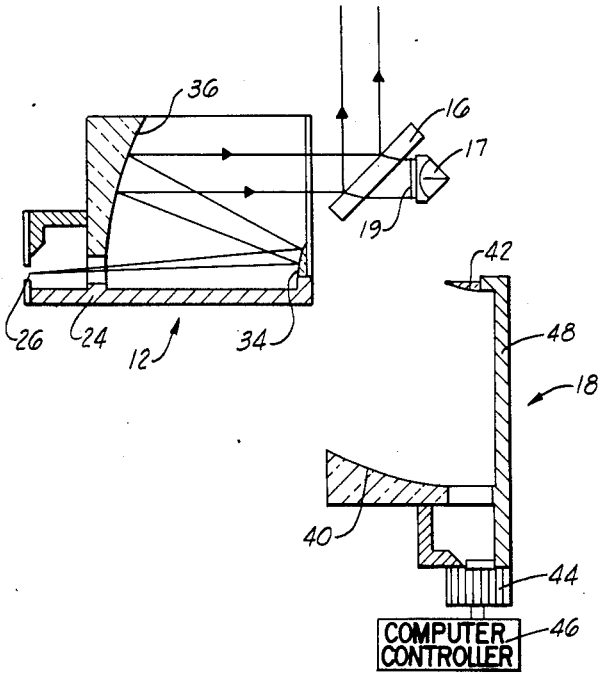
Figure 3D:
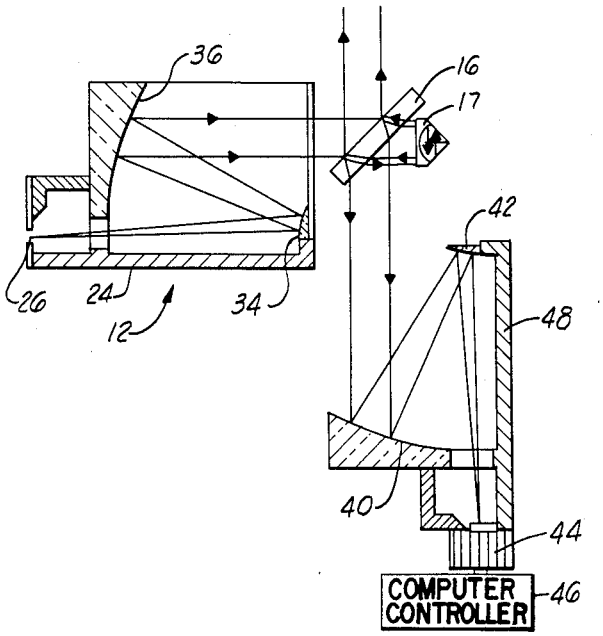
Figure 9:
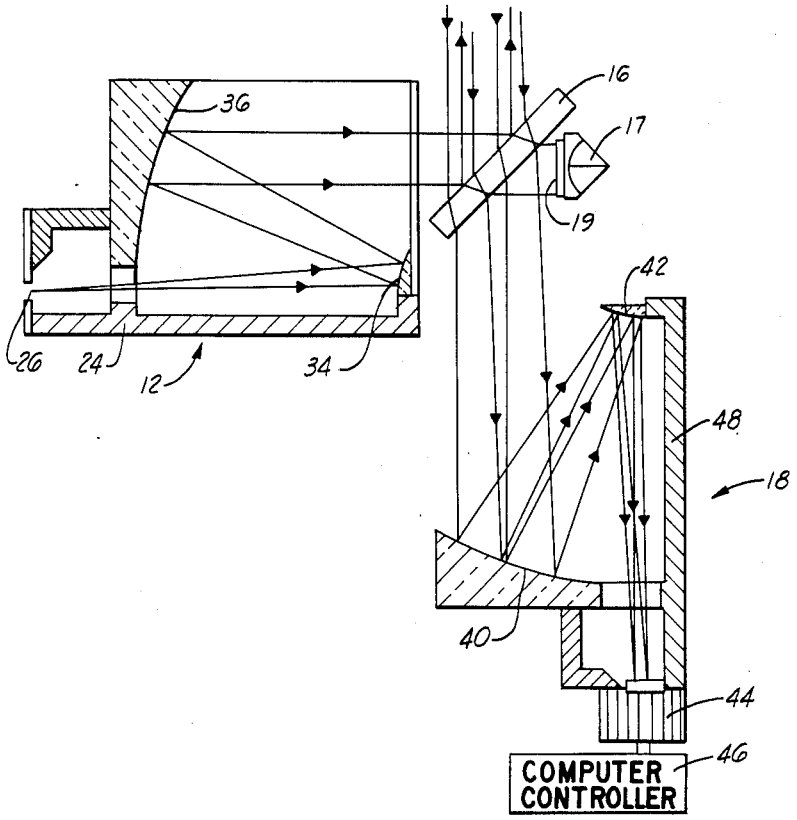

In FIG. 7 an operator 80 is shown in front of the alignment verification device 10 with the boresight target reference source 12 and boresight error sensor 18 mounted on a portable cart 82 with a monitor 84 connected to the device 10, with adjustable elevation and azimuth screws 86 providing a rough adjustment of the collimated beam 14. The extendable periscope 20 is supported by an adjustable tripod 88 with one end of the periscope 88 positioned in front of an optical reference fixture 90 mounted along a line of sight 91 of an aircraft 92 that, in this example, is a helicopter. The optical reference fixture 90 is similar to the reference fixture 70 shown in FIG. 6A. To align the boresight system of the aircraft 92 line of sight shown as the dotted line 91, the adjustment screws 86 on the cart 82 are moved. These angularly move the reference source 12. The reference source 12 outputs the collimated radiation beam 14 that is partially reflected off of the beamsplitter 16 shown in FIG. 9A and transmitted through the periscope 20. The collimated radiation beam 14 impinges onto the reference fixture 90 where a cube corner prism retro-reflects half of the energy back at the same angle it is received. The other half of the energy is reflected by the coating on the front surface of the prism at twice the alignment error or $2\Phi$ of the boresight system with reference to the aircraft line of sight 91. This angular relationship is shown in FIG. 6A. Both the retroreflection and the reference error reflection enter the periscope 20 and are transmitted onto the beamsplitter 16 as shown in FIG. 9A. The beamsplitter 16 transmits half of the radiation of both of these reflections onto the sensor optics 40 and 42 where they are then focused onto the matrix camera 44 as two different spots. The boresight system is now coarsely aligned. Fine alignment is achieved by moving the source spot with the two-axis stepping motor 32 with worm gear 30 as shown in FIG. 2A. The fine alignment is finished when both spots on the matrix camera 44 become one as shown in FIG. 9B. The spot on the matrix camera 44 is a reference to the vehicle 92 and is stored into the memory of the computer control 46. When this has been accomplished all other sighting and weapon systems on the vehicle 92 are then boresighted to this reference. A front view of the device 10 and tripod 88 can be seen in FIG. 8.

Alignment of the boresight system to a vehicle sighting system such as FLIR, TV, VISIBLE OPTICS or similar sighting system is shown as reference numeral 96 in FIG. 7. In this figure the periscope 20, shown in dotted lines, is now projected in front of the sighting system 96. The pilot or gunner of the aircraft 92 looks at this sighting system to see where the radiation is being focused on his optical system, that is, if the spot is coincident with the center of his sighting reticle. If the spot is not centered on the sighting system reticle, he tells the operator 80 to adjust the adjustment screws 86 until the spot is coarsely aligned with the reticle. Then the fine adjustment stepping motor 32 is used to place the spot directly on the reticle center. The boresight system is now aligned to the aircraft's sighting system that is used as the aircraft reference. Referring to FIG. 9C, the cube corner prism 17 entrance is blocking by a shield 19 during this search for alignment. Now that the system is aligned to the aircraft 92, the cube corner prism 17 is unblocked and 50% of the source radiation goes through the beamsplitter 16 onto the prism 17 as shown in FIG. 9D. The prism 17 retroreflects the radiation at the same angle it enters. Once again, 50% of the retroreflected beam is impinged on the beam splitter 16 and is reflected onto the optics of the sensor system 18 that focus the beam onto the matrix camera 44. The spot on the matrix camera 44 is the reference of the aircraft and is stored into the memory of the computer control 46. All other sighting and weapon systems on the aircraft are then boresighted to this reference.

In order to test a weapon system boresight to the vehicle reference it is necessary for the weapon system to have an optical reference fixture 70 as shown in FIG. 6. In some weapon systems there is already a built-in optical reference fixture. After the optical reference fixture has been attached to the weapon system, the periscope arm 20 is placed in front of the optical reference fixture 70 and irradiates the prism that reflects and retroreflects the radiation back into the periscope 20. The periscope 20 transmits the two different angular beams onto the beamsplitter 16 that transmits them through the entrance of the sensor system 18.

The sensor optics focus the two angular beams onto the matrix camera 44 where they show up as two different spots as shown in FIG. 9E. The camera transmits the spot information to the computer controller 46 that determines the angular difference between the two spots. Since one of the beams is a reference beam, that is the beam retroreflected by the prism, the error between them is double the boresight error. This figure is stored in memory, is halved and reported as the true boresight error, is used to make adjustments and is rechecked until no further adjustments are necessary.

The periscope 20 is then moved to other weapon systems that may be in various positions on the aircraft 92 in FIG. 10, for adjusting these weapon systems or sighting systems until all the systems have been checked and properly adjusted.

Changes may be made in the construction and arrangement of the parts or elements of the embodiments as described herein without departing from the spirit or scope of the invention defined in the following claims.

What is claimed is:

1. A method of boresight aligning a vehicle mounted weapon system to a vehicle-mounted sighting system, said method comprising the steps of:

disposing means for generating a collimated light ray in spaced, independent and generally proximate relation to the optical input of said sighting system;

projecting said collimated light ray into one end of a periscope formed of a plurality of cascaded rhomboid reflectors serially interconnected for articulation relative to said vehicle and in planes spaced from said vehicle and perpendicular to the projected light ray;

aligning the other end of said periscope with the optical input of said sighting system;

adjusting said generating means to centrally align said light ray on a reticle of said sighting system;

diverting a portion of the collimated light ray projected from the adjusted generating means to a sensor means;

recording the position on the sensor means of the diverted light ray as representative of the boresight of said sighting system;

aligning the other end of said periscope with a reflective reference fixture fixed on said weapon system;

conducting a collimated light ray reflected by said fixture through said periscope to said sensor means;

recalling the recorded sighting system boresight position on said sensor means; and comparing on said sensor means the reflected collimated light ray with the recorded boresight of said sighting system to determine the boresight error of said weapon system.

2. A boresight alignment device for optically determining alignment of a vehicle-mounted weapons system having a reflective reference fixture defining the boresight thereof to a vehicle boresight based on a reflective reference fixture mounted on said vehicle or to a vehicle-mounted sighting system, said device comprising:

a portable housing for independent disposition in spaced relation to said vehicle;

means in said housing for generating a collimated light ray;

periscope means for providing two-way reflective optical communication of collimated light rays, one end of said periscope means being rotatably attached to said housing in optical communication with said generating means, and the other end of said periscope means being radially and annularly moveable relative to said housing and movable relative to said vehicle for selective optical alignment with one of said sighting system and said reference fixture;

means in said reference fixture for retroreflecting part of said light ray and for reflecting part of said light ray at a predetermined angle of said retroreflected light ray;

means for adjusting the path of the light ray from said generating means to a path representative of the boresight of said vehicle or of said sighting system; and sensor means disposed in said housing for receiving and recording the light rays reflected through said periscope means from said reference fixture, said reflected light rays generating on said sensor means two points representative of the boresight error between said weapons system and one of said vehicle boresight and said sighting system.

3. The device of claim 2 wherein said generating means comprises a light source and an optical collimator.

4. The device of claim 3 wherein said sensor means comprises a matrix camera operatively connected to a computer controller and an optical collimator disposed to receive collimated light rays and transmit uncollimated light to said camera.

5. The device of claim 4 also including a cube corner prism and parallel plate beam splitter disposed in the optical paths between said generating means, said sensor means and the one end of said periscope means.

6. The device of claim 5 also including means for selectively obstructing said cube corner prism to prevent direct optical communication between said generating means and said sensor means.

7. The device of claim 2 wherein said periscope means comprises a plurality of individual, cascaded rhomboid reflectors connected together in series for articulation in planes perpendicular to said generated collimated ray.

* * * * *